US008130910B2

(12) United States Patent
Davies et al.

(10) Patent No.: US 8,130,910 B2
(45) Date of Patent: Mar. 6, 2012

(54) LIQUID-COOLED APERTURE BODY IN AN X-RAY TUBE

(75) Inventors: Jason W. Davies, Cottonwood Heights, UT (US); Gregory C. Andrews, Draper, UT (US); George Benjamin Naseath, West Jordan, UT (US); Lincoln Curtis Jolley, Stansbury Park, UT (US); Richard Alma Keyes, West Valley City, UT (US); Ricky Burnett Smith, Sandy, UT (US)

(73) Assignee: Varian Medical Systems, Inc., Palo Alto, CA (US)

( * ) Notice: Subject to any disclaimer, the term of this patent is extended or adjusted under 35 U.S.C. 154(b) by 0 days.

(21) Appl. No.: 12/778,927

(22) Filed: May 12, 2010

(65) Prior Publication Data

US 2011/0038462 A1 Feb. 17, 2011

Related U.S. Application Data

(63) Continuation-in-part of application No. 12/541,802, filed on Aug. 14, 2009.

(60) Provisional application No. 61/249,534, filed on Oct. 7, 2009, provisional application No. 61/262,480, filed on Nov. 18, 2009.

(51) Int. Cl.
*H01J 35/02* (2006.01)

(52) U.S. Cl. ..... 378/142; 378/139; 378/140; 378/141; 378/161

(58) Field of Classification Search ..... 378/139–142, 378/161

See application file for complete search history.

(56) References Cited

U.S. PATENT DOCUMENTS

| | | | | |
|---|---|---|---|---|
| 5,689,542 | A * | 11/1997 | Lavering et al. | 378/142 |
| 6,115,454 | A * | 9/2000 | Andrews et al. | 378/140 |
| 6,215,852 | B1 | 4/2001 | Rogers et al. | |
| 6,263,046 | B1 | 7/2001 | Rogers | |
| 6,438,208 | B1 | 8/2002 | Koller | |
| 6,519,318 | B1 * | 2/2003 | Andrews | 378/141 |
| 6,529,579 | B1 * | 3/2003 | Richardson | 378/130 |
| 6,714,626 | B1 | 3/2004 | Subraya et al. | |
| 7,016,472 | B2 | 3/2006 | Subraya et al. | |
| 7,058,160 | B2 * | 6/2006 | Boye | 378/125 |
| 7,382,862 | B2 * | 6/2008 | Bard et al. | 378/121 |
| 7,486,774 | B2 * | 2/2009 | Cain | 378/136 |
| 7,983,395 | B2 * | 7/2011 | Saito | 378/140 |
| 2006/0269048 | A1 * | 11/2006 | Cain | 378/142 |
| 2008/0317210 | A1 * | 12/2008 | Lu et al. | 378/141 |

* cited by examiner

*Primary Examiner* — Edward Glick
*Assistant Examiner* — Thomas R Artman
(74) *Attorney, Agent, or Firm* — Maschoff Gilmore & Israelsen

(57) ABSTRACT

A liquid-cooled aperture body in an x-ray tube. In one example embodiment, an x-ray tube is configured to be at least partially submerged in a liquid coolant. The x-ray tube includes a cathode at least partially positioned within a cathode housing, an anode at least partially positioned within a can, and an aperture body coupling the cathode housing to the can. The can is formed from a first material and the aperture body is formed from a second material. The aperture body defines an aperture through which electrons may pass between the cathode and the anode. The aperture body further defines at least two exterior surfaces that are each configured to be exposed to the liquid coolant in which the x-ray tube is at least partially submerged.

21 Claims, 7 Drawing Sheets

LIQUID-COOLED APERTURE BODY IN AN X-RAY TUBE

CROSS-REFERENCE TO RELATED APPLICATIONS

This application claims the benefit of U.S. Provisional Patent Application Ser. No. 61/249,534, filed on Oct. 7, 2009, and U.S. Provisional Patent Application Ser. No. 61/262,480, filed on Nov. 18, 2009, each of which is incorporated herein by reference in its entirety. This application is also a continuation-in-part of U.S. patent application Ser. No. 12/541,802, filed on Aug. 14, 2009, which is also incorporated herein by reference in its entirety.

BACKGROUND

An x-ray tube directs x-rays at an intended target in order to produce an x-ray image. To produce x-rays, the x-ray tube receives large amounts of electrical energy. However, only a small fraction of the electrical energy transferred to the x-ray tube is converted within an evacuated enclosure of the x-ray tube into x-rays, while the majority of the electrical energy is converted to heat. If excessive heat is produced in the x-ray tube, the temperature may rise above critical values, and various portions of the x-ray tube may be subject to thermally-induced deforming stresses. Such thermally-induced deforming stresses may produce leaks in the evacuated enclosure of the x-ray tube, which thereby limits the operational life of the x-ray tube.

For example, the portion of the evacuated enclosure positioned between the cathode and the anode of the x-ray tube is particularly susceptible to excessive heat and thermally-induce deforming stresses. In particular, this portion of the evacuated enclosure may be excessively heated by backscatter electrons.

In addition to increasing the likelihood of a vacuum leaks, the heat produced during x-ray tube operation may also result in the boiling of a liquid coolant in which the x-ray tube is at least partially submerged and that is in direct contact with the x-ray tube window. This boiling of the liquid coolant may result in detrimental fluctuations in the attenuation in the x-rays as they pass through the boiling liquid on their way to the intended target. This detrimental x-ray attenuation fluctuation of the x-rays may cause defects in the resulting x-ray images of the target, which may result, for example, in a misdiagnosis of a patient being x-rayed.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY OF SOME EXAMPLE EMBODIMENTS

In general, example embodiments relate to a liquid-cooled aperture body in an x-ray tube. The liquid-cooled aperture body collects heat generated as a by-product of x-ray tube operation and transfers this heat to circulating liquid coolant that is in contact with the aperture body. This transfer of heat to the circulating liquid coolant decreases thermally-induced deforming stresses in the aperture body and other x-ray tube components that are coupled to the aperture body. This decrease in thermally-induced deforming stresses in x-ray tube components reduces leaks in the evacuated enclosure of the x-ray tube, which thereby extends the operational life of the x-ray tube. Further, this transfer of heat to the circulating liquid coolant decreases boiling of the liquid coolant that is positioned between the x-ray tube window and the intended target, which reduces defects in the resulting x-ray images of the intended target.

In one example embodiment, an x-ray tube is configured to be at least partially submerged in a liquid coolant. The x-ray tube includes a cathode at least partially positioned within a cathode housing, an anode at least partially positioned within a can, and an aperture body coupling the cathode housing to the can. The can is formed from a first material and the aperture body is formed from a second material. The aperture body defines an aperture through which electrons may pass between the cathode and the anode. The aperture body further defines at least two exterior surfaces that are each configured to be exposed to the liquid coolant in which the x-ray tube is at least partially submerged.

In another example embodiment, an x-ray tube is configured to be at least partially submerged in a liquid coolant. The x-ray tube includes a cathode at least partially positioned within a cathode housing, an anode at least partially positioned within a can, and an aperture body formed from a second material. The can is formed from a first material and the aperture body is formed from a second material. The aperture body defines an aperture through which electrons may pass between the cathode and the anode. The aperture body further defines one or more exterior surfaces. At least fifty percent of the area of the exterior surfaces of the aperture body is configured to be exposed to the liquid coolant in which the x-ray tube is at least partially submerged.

In yet another example embodiment, an x-ray tube is configured to be at least partially submerged in a liquid coolant. The x-ray tube includes a cathode at least partially positioned within a cathode housing, an anode at least partially positioned within a can, and an aperture body coupling the cathode housing to the can. The can is formed from a material comprising stainless steel and the aperture body is formed from a material comprising copper. The aperture body defines an aperture through which electrons may pass between the cathode and the anode. The aperture body further defines two orthogonal brazing surfaces that are brazed to two corresponding orthogonal brazing surfaces defined by the can.

These and other aspects of example embodiments of the invention will become more fully apparent from the following description and appended claims.

BRIEF DESCRIPTION OF THE DRAWINGS

To further clarify certain aspects of the present invention, a more particular description of the invention will be rendered by reference to example embodiments thereof which are disclosed in the appended drawings. It is appreciated that these drawings depict only example embodiments of the invention and are therefore not to be considered limiting of its scope. Aspects of example embodiments of the invention will be described and explained with additional specificity and detail through the use of the accompanying drawings in which.

DETAILED DESCRIPTION OF SOME EXAMPLE EMBODIMENTS

Example embodiments of the present invention relate to a liquid-cooled aperture body in an x-ray tube. The liquid-cooled aperture body collects heat generated as a by-product of x-ray tube operation and transfers this heat to circulating liquid coolant that is in contact with the aperture body. This transfer of heat to the circulating liquid coolant decreases thermally-induced deforming stresses in the aperture body and other x-ray tube components that are coupled to the aperture body. This decrease in thermally-induced deforming stresses in x-ray tube components reduces leaks in the evacuated enclosure of the x-ray tube, which thereby extends the operational life of the x-ray tube. Further, this transfer of heat to the circulating liquid coolant decreases boiling of the liquid coolant that is positioned between the x-ray tube window and the intended target, which reduces defects in the resulting x-ray images of the intended target.

Reference will now be made to the drawings to describe various aspects of example embodiments of the invention. It is to be understood that the drawings are diagrammatic and schematic representations of such example embodiments, and are not limiting of the present invention, nor are they necessarily drawn to scale.

1. Example Housing and Example X-Ray Tube

Figure 1A:
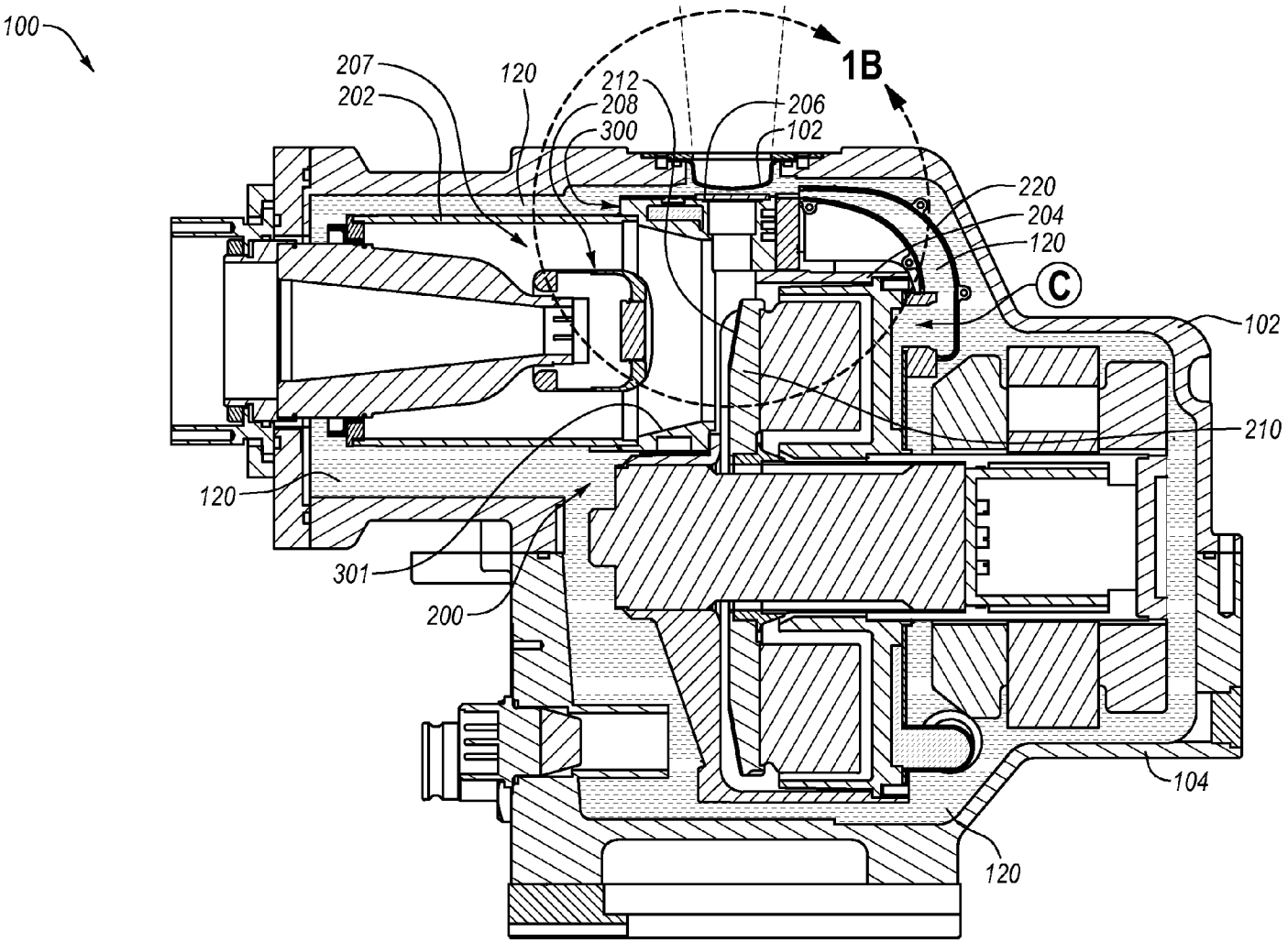
FIG. 1A is a cross-sectional side view of an example housing and an example x-ray tube.
Figure 1B:
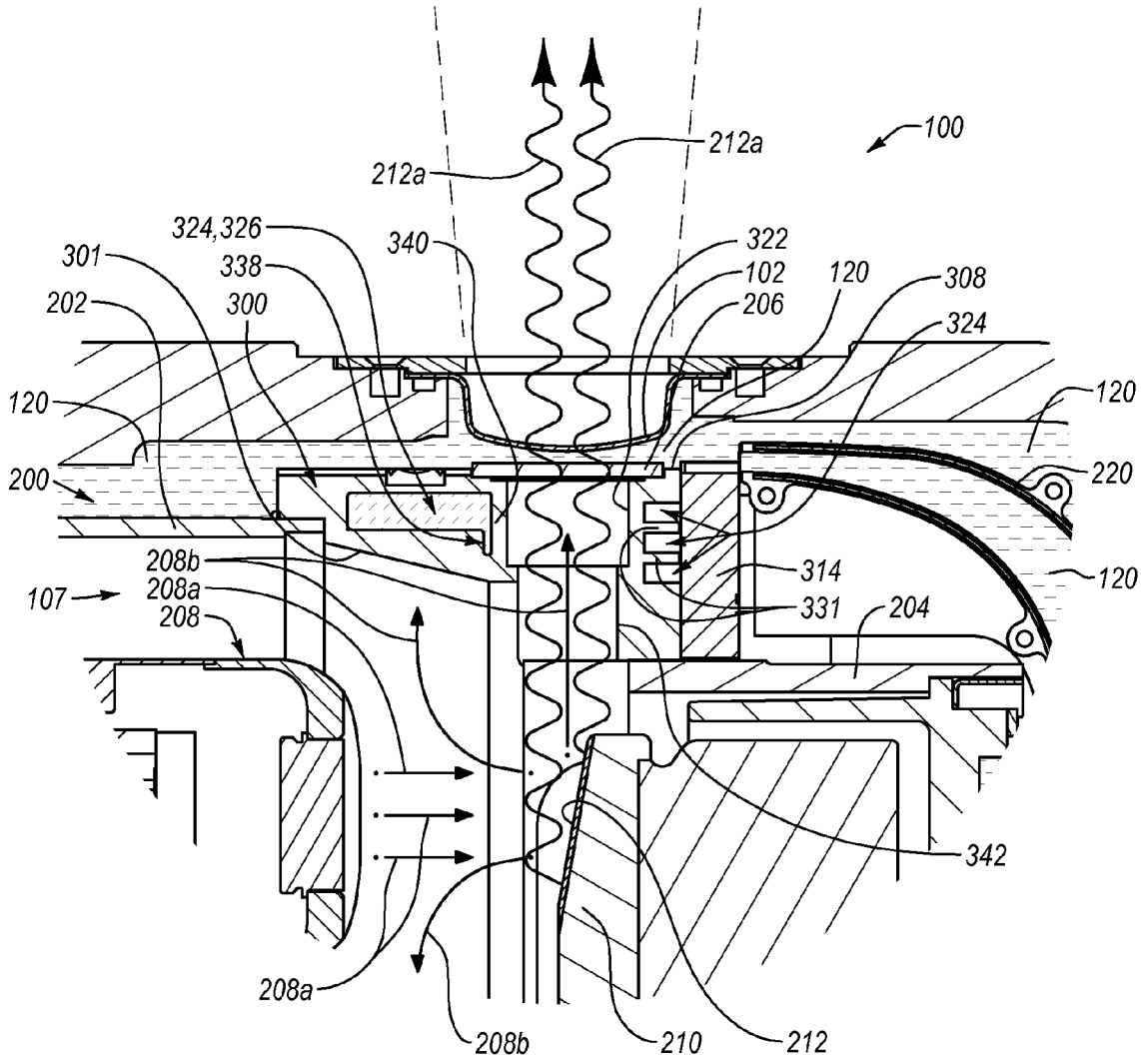
FIG. 1B is an enlarged cross-sectional side view of the example housing and the example x-ray tube of FIG. 1A.

With reference first to FIGS. 1A and 1B, an example housing 100 containing an example x-ray tube 200 is disclosed. As disclosed in FIG. 1A, the interior surfaces of the example housing 100 define a coolant reservoir. Further, a reservoir window 102 is mounted in the housing 100. The reservoir window 102 is comprised of an x-ray transmissive material, such as beryllium or other suitable material(s).

Also disclosed in FIG. 1A, the example x-ray tube 200 generally includes a cathode housing 202, a can 204, an aperture body 300 coupling the cathode housing 202 to the can 204, and an x-ray tube window 206 is attached to the aperture body 300. The x-ray tube window 206 is comprised of an x-ray transmissive material, such as beryllium or other suitable material(s). The can 204 is formed from a first material and the aperture body 300 is formed from a second material. In at least some example embodiments, the first material has a first thermal conductivity and the second material has a second thermal conductivity that is greater than the first thermal conductivity.

For example, the can 204 may be formed from stainless steel, such as 304 stainless steel. In this example, the aperture body 300, in contrast, will be formed from a material that has a thermal conductivity that is greater than the thermal conductivity of stainless steel, and in particular that is greater than the thermal conductivity of 304 stainless steel. For example, the aperture body 300 may be formed from copper, such as Oxygen-Free High Conductivity (OFHC) copper, aluminum, silver, gold, various refractory materials, or any other material that has a thermal conductivity that is greater than the thermal conductivity of 304 stainless steel. In general, forming the aperture body 300 from a material that has a thermal conductivity that is greater than the thermal conductivity of 304 stainless steel results in improved cooling of the aperture body 300 by liquid coolant flowing against exterior and interior surfaces of the aperture body 300, as discussed in greater detail below in connection with FIGS. 3A and 3B.

As disclosed in FIG. 1A, the cathode housing 202, the aperture body 300, the x-ray tube window 206, and the can 204 at least partially define an evacuated enclosure 207 within which a cathode 208 and an anode 210 are positioned. More particularly, the cathode 208 is at least partially positioned within the cathode housing 202 and the anode 210 is at least partially positioned within the can 204. The anode 210 is spaced apart from and oppositely disposed to the cathode 208, and may be at least partially composed of a thermally conductive material such as copper or a molybdenum alloy for example. The anode 210 and cathode 208 are connected in an electrical circuit that allows for the application of a high voltage potential between the anode 210 and the cathode 208. The cathode 208 includes a filament (not shown) that is connected to an appropriate power source (not shown).

As disclosed in FIG. 1B, prior to operation of the example x-ray tube 200, the evacuated enclosure 207 is evacuated to create a vacuum. Then, during operation of the example x-ray tube 200, an electrical current is passed through the filament of the cathode 208 to cause electrons 208*a*, to be emitted from the cathode 208 by thermionic emission. The application of a high voltage differential between the anode 210 and the cathode 208 then causes the electrons 208*a* to accelerate from the cathode filament, through a tapered aperture 301 defined in the aperture body 300, and toward a focal track 212 that is positioned on the anode 210. The focal track 212 may be composed for example of tungsten or other material(s) having a high atomic ("high Z") number. As the electrons 208*a* accelerate, they gain a substantial amount of kinetic energy, and upon striking the target material on the focal track 212, some of this kinetic energy is converted into x-rays 212*a*.

The focal track 212 is oriented so that emitted x-rays 212*a* are directed toward the x-ray tube window 206 and the reservoir window 102. As both the x-ray tube window 206 and the reservoir window 102 are comprised of x-ray transmissive materials, the x-rays 212*a* emitted from the focal track 212 pass through the x-ray tube window 206, and the reservoir window 102 in order to strike an intended target (not shown) to produce an x-ray image (not shown). The window 206 therefore seals the vacuum of the evacuated enclosure of the x-ray tube 200 from the pressure from a liquid coolant 120 in which the x-ray tube 200 is at least partially submerged, and yet enables x-rays 212*a* generated by the rotating anode 210 to exit the x-ray tube 200, pass through the coolant 120, and exit the housing 100 through the corresponding window 102 mounted in the housing 100.

The orientation of the focal track 212 also results in some of the electrons 208*a* being deflected off of the focal track 212 toward various interior surfaces of the aperture body 300 and the inside surface of the x-ray tube window 206. These deflected electrons are referred to as "backscatter electrons" 208*b* herein. The backscatter electrons 208*b* have a substantial amount of kinetic energy. When the backscatter electrons 208*b* strike the interior surfaces of the aperture body 300 and the x-ray tube window 206, a significant amount of the kinetic energy of the backscatter electrons 208*b* is transferred to the evacuated aperture body 300 and the x-ray tube window 206 as heat.

Although the example x-ray tube 200 is depicted as a rotary anode x-ray tube, example embodiments disclosed herein may be employed in any type of x-ray tube that utilizes circulating liquid coolant. Thus, the example x-ray tube liquid coolant circulation system disclosed herein may alternatively be employed, for example, in a stationary anode x-ray tube.

2. Example X-Ray Tube Liquid Coolant Circulation System

Figure 2A:
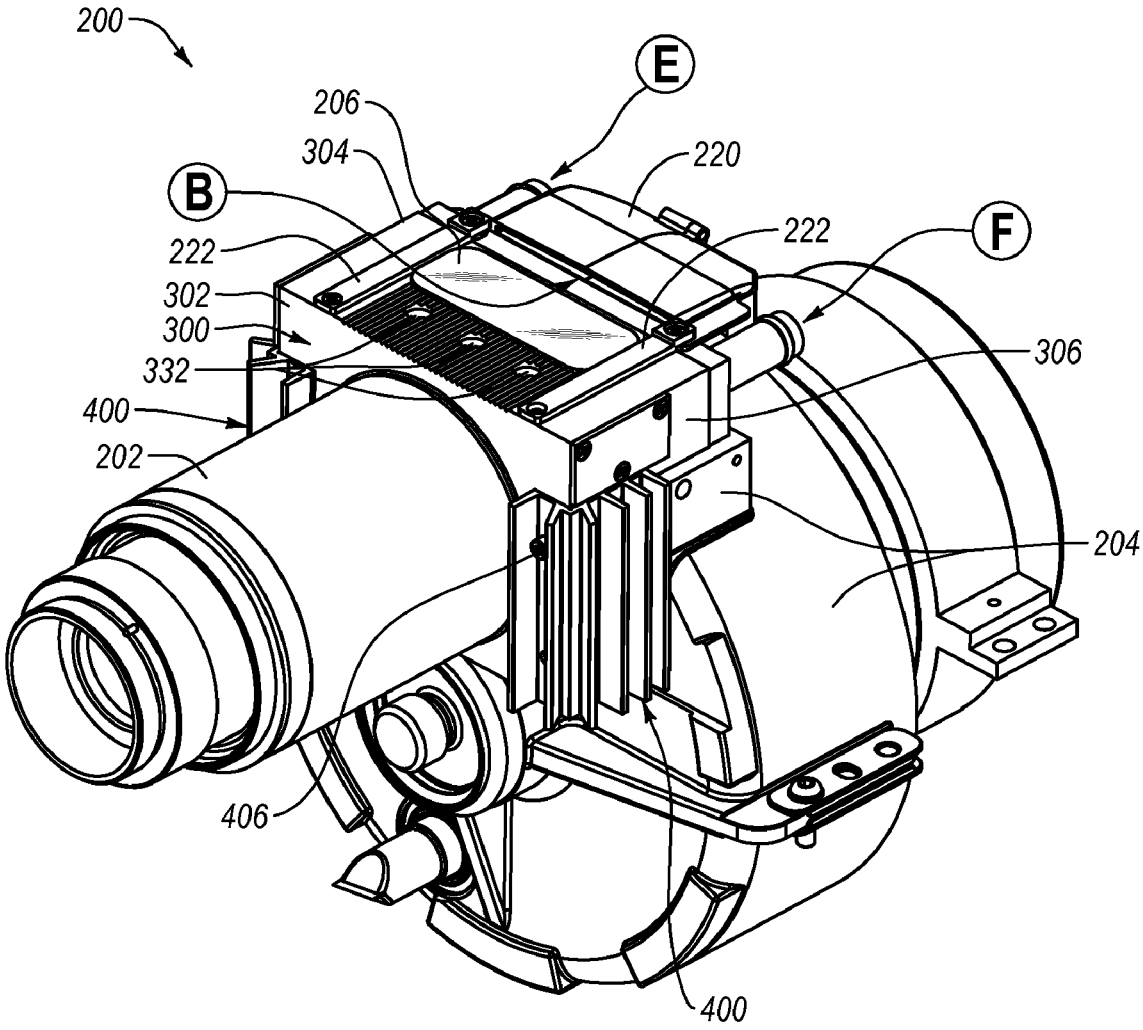
FIG. 2A is a front perspective view of the example x-ray tube of FIG. 1A.
Figure 2B:
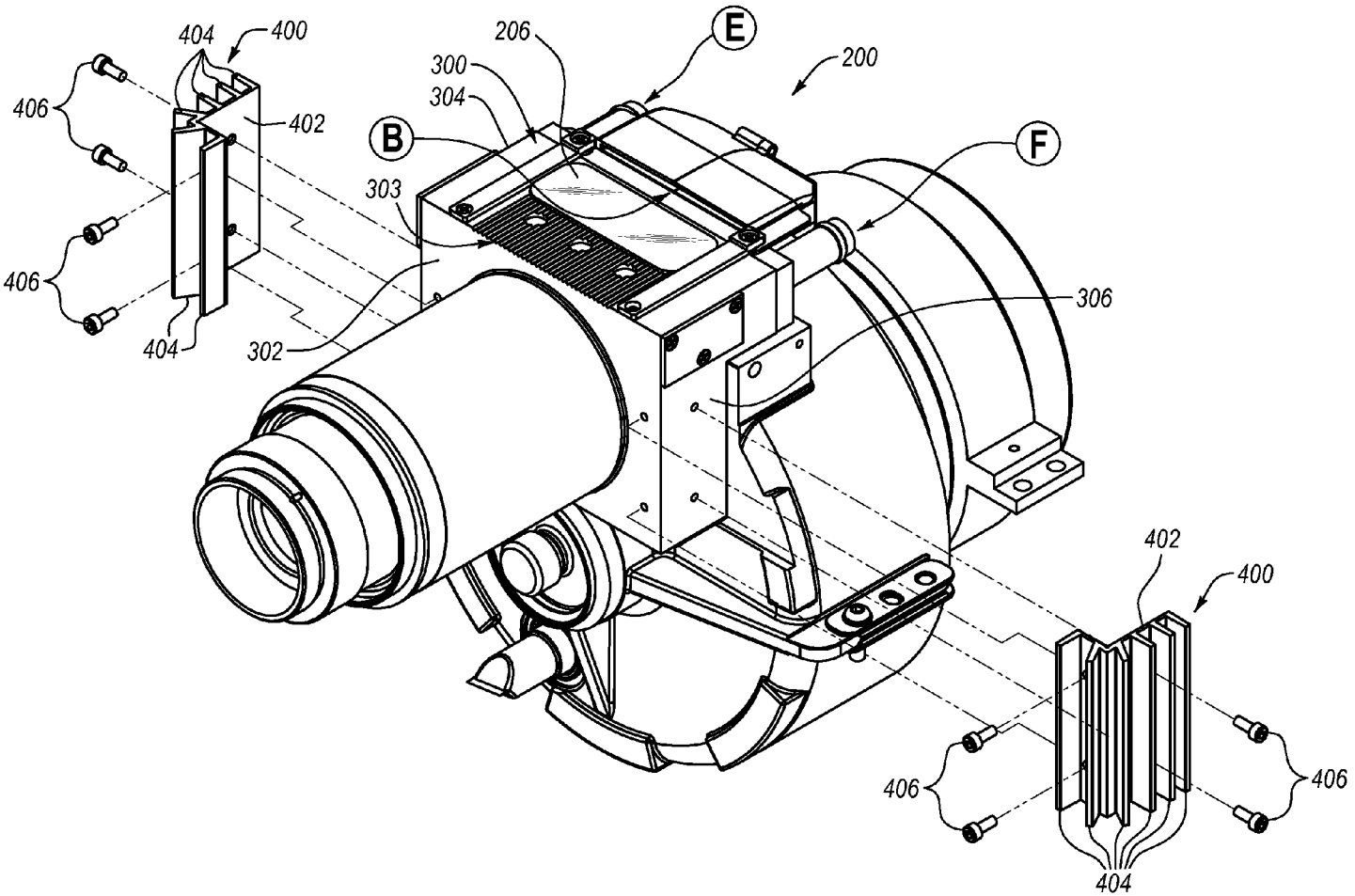
FIG. 2B is a partially exploded front perspective view of the example x-ray tube of FIG. 2A.

With continued reference to FIG. 1A, and with reference also to FIGS. 2A and 2B, aspects of an example x-ray tube liquid coolant circulation system is disclosed. The example x-ray tube example x-ray tube liquid coolant circulation system generally functions to dissipate heat in the x-ray tube 200, including heat in the aperture body 300 and the x-ray tube window 206, by circulating a liquid coolant 120. In one example embodiment, the liquid coolant 120 may be a dielectric liquid coolant. Examples of dielectric liquids include, but are not limited to: fluorocarbon or silicon based oils, SYLTHERM, or de-ionized water. The example x-ray tube liquid coolant circulation system includes a heat exchanger or other means for cooling the coolant 120 (not shown), which functions to circulate the coolant 120 between the heat exchanger and the example housing 100 and x-ray tube 200.

A first example mode of operation of the example x-ray tube liquid coolant circulation system will now be disclosed. First, cooled coolant 120 flows into a hose (not shown) that is positioned within the reservoir that is defined within the housing 100. At coolant port F (FIGS. 2A and 2B), the coolant 120 flows into the aperture body 300. The coolant 120 then flows through interior coolant passageways 324 and 326 of the aperture body 300, as discussed below in connection with FIGS. 3A and 3B. The coolant 120 then exits the aperture body 300 at coolant port E (FIGS. 2A and 2B) and flows through a hose (not shown) into various interior coolant passageways defined in the can 204. Then, at port C (FIG. 1A), the coolant 120 flows into a plenum 220. At port B (FIGS. 2A and 2B), the coolant 120 is directed out of the plenum 220 and across the x-ray tube window 206. In addition, flow guides 222 (FIG. 2A) mounted on the aperture body 300 on either side of the x-ray tube window 206 may further assist in directing the coolant 120 to flow across the x-ray tube window 206. After exiting port B of the plenum 220, the coolant 120 fills the reservoir defined by the interior surfaces of the housing 100 such that the x-ray tube 200 is at least partially submerged in the coolant 120, as disclosed in FIG. 1A. As the coolant 120 is actively circulated through interior passageways of the x-ray tube 200 and then somewhat more passively circulated around exterior surfaces of the x-ray tube 200, the temperature of the coolant 120 is raised as heat generated by the x-ray tube 102 is transferred to the coolant 120. Finally, the heated coolant 120 exits the housing 100. In some examples, the heated coolant 120 exiting the housing 100 is circulated by a pump to an external heat exchanger (not shown), or is otherwise cooled, before being circulated back into the housing 100.

The first example mode of operation described above is only one example of an operation mode for the example x-ray tube liquid coolant circulation system. In a second example mode of operation, the coolant 120 is circulated in the opposite direction from that described above.

As the coolant 120 circulates through the aperture body 300 and across the x-ray tube window 206, the coolant 120 functions to transfer the heat in the aperture body 300 and the x-ray tube window 206 caused by the impingement of the backscatter electrons 208*b* (see FIG. 1B) to the circulating coolant 120. Transferring this heat to the circulating coolant 120 decreases thermally-induced deforming stresses in the components of the x-ray tube 200, reduces leaks in the evacuated enclosure 207 of the x-ray tube 200, and thereby extends the operational life of the x-ray tube 200. Further, this transfer of heat to the circulating coolant 120 decreases boiling of the coolant 120 that is in direct contact with the x-ray tube window 206, which reduces defects in the resulting x-ray images of the intended target.

3. Example Exterior Fin Sets

With continued reference to FIGS. 2A and 2B, aspects of fin sets 400 are disclosed. As disclosed in FIG. 2A, each fin set 400 includes a connecting surface 402 and a plurality of fins 404. Each fin set 400 is configured to be attached to exterior surfaces 302 and 304, or exterior surfaces 304 and 306, of the aperture body 300. In at least some example embodiments, the fin sets 400 may be formed from a material that has a thermal conductivity that is greater than the thermal conductivity of material from which the can 204 is formed. For example, the fin sets 400 may be formed from the same material from which the aperture body 300 is formed. Further the fin sets 400 may be extruded from copper or aluminum, for example. As disclosed in FIGS. 2A and 2B, each fin set 400 may be attached to the aperture body 300 using fasteners 406. Alternatively, each fin set 400 may instead be mechanically attached, adhesively attached, brazed, or otherwise attached to the aperture body 300, for example.

Each of the fins 404 is configured to be exposed to the coolant 120 in which the x-ray tube 200 is at least partially submerged (see FIG. 1A). The fins 404 effectively extend the surface area of the exterior surfaces 302, 304, and 306 of the aperture body 300, thus increasing the heat transfer rate of these surfaces. It is understood that although twelve fins 404 are disclosed in the embodiment of FIG. 2B, less than twelve fins 404 or greater than twelve fins 404 may instead be attached to the aperture body 300, depending on the desired heat transfer rate of a particular embodiment.

In addition to the fin sets 400, one or more surfaces of the aperture body 300 may further include integral corrugated surfaces 303. For example, as disclosed in FIG. 2B, the corrugated surfaces 303 are positioned near the window 206 to effectively extend the surface area near the window 206. This extended surface area increases the heat transfer rate of the aperture body 300 in the vicinity of the window 206.

4. Example Aperture Body

Figure 3A:
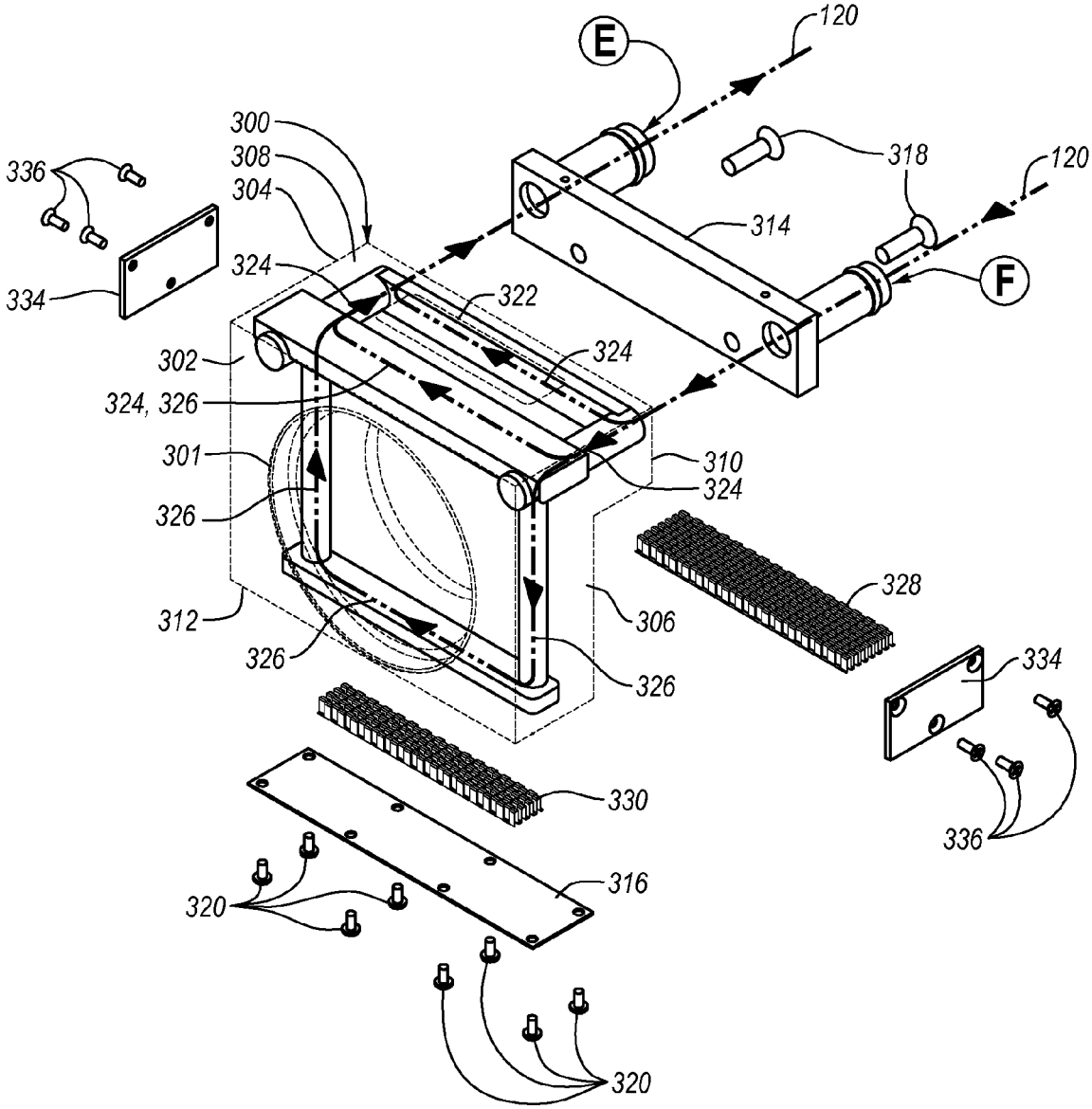
FIG. 3A is an exploded front perspective view of an example aperture body and related components of the example x-ray tube of FIG. 1A.
Figure 3B:
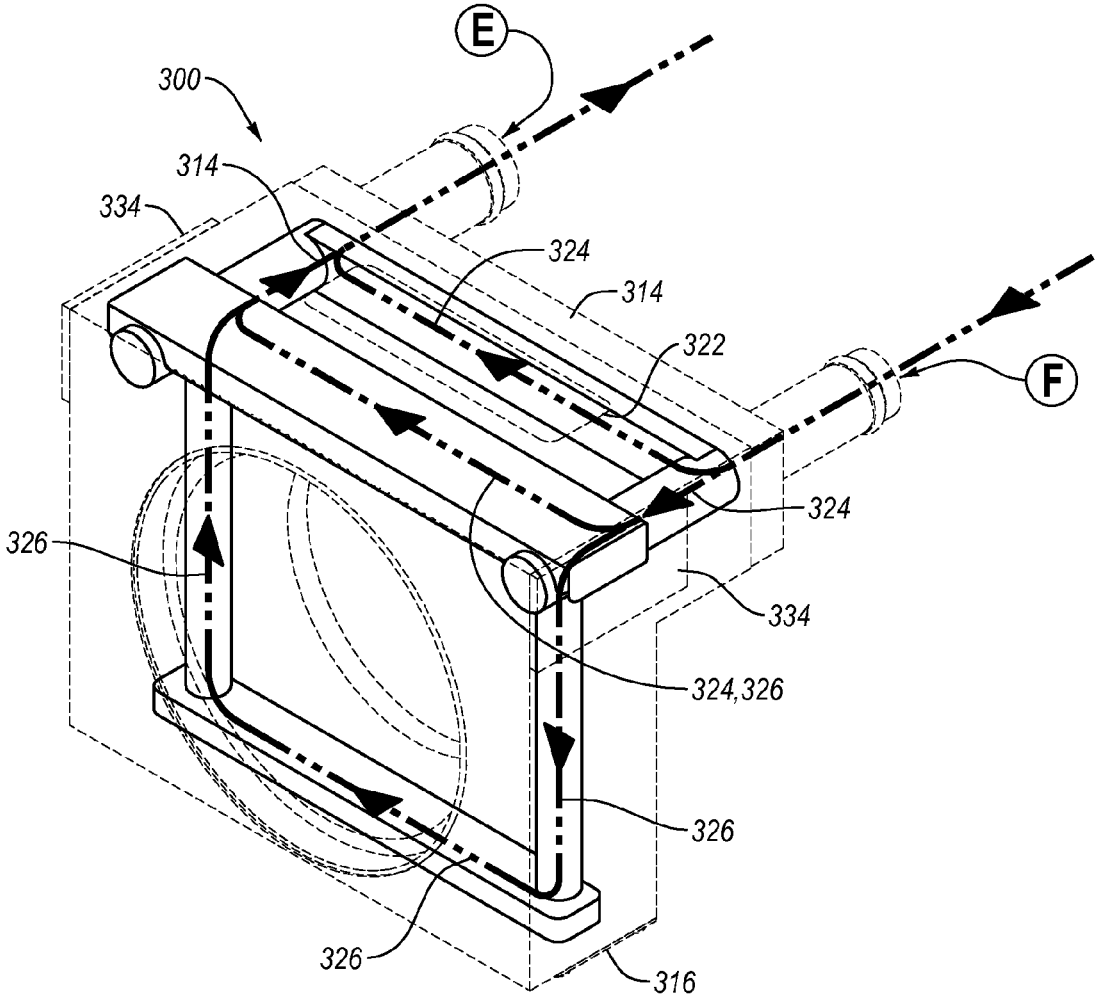
FIG. 3B is a front perspective view of the example aperture body and related components of FIG. 3A after assembly.

With reference to FIGS. 3A and 3B, additional aspects of the aperture body 300 are disclosed. As disclosed in FIG. 3A, the aperture body 300 defines multiple exterior surfaces that are each configured to be exposed to the circulating coolant 120 in which the x-ray tube 200 is at least partially submerged (see FIG. 1A). For example, the aperture body 300 defines an exterior front surface 302, exterior side surfaces 304 and 306, and an exterior top surface 308 that are each configured to be directly exposed to the circulating coolant 120. The combined surface areas of surfaces 302-308 result in at least fifty percent of the area of the exterior surfaces of the aperture body 300 being configured to be directly exposed to the circulating coolant 120 in which the x-ray tube 200 is at least partially submerged. As used herein, the phrase "the exterior surfaces of the aperture body 300" refers to the surfaces of the aperture body 300 that are not completely surrounded by the aperture body 300. For example, "the exterior surfaces of the aperture body 300" does not include the interior surfaces of the aperture 301 nor the interior surfaces of the interior coolant passageways 324 and 326, discussed below.

In addition, the aperture body 300 also defines a rear surface 310 and a bottom surface 312 that are only separated from direct exposure to the coolant 120 by relatively thin conductive materials. In particular, the rear surface 310 is separated from direct exposure to the coolant 120 by a relatively thin conductive manifold 314, and the bottom surface 312 is separated from direct exposure to the coolant 120 by a relatively thin conductive plate 316. As disclosed in FIG. 3A, the manifold 314 may be attached to the aperture body 300 using fasteners 318, and the plate 316 may be attached to the aperture body using fasteners 320.

Accordingly, the aperture body 300 defines four exterior surfaces (302, 304, 306, and 308) that are each configured to be directly exposed to the circulating coolant 120 in which the x-ray tube 200 is at least partially submerged (see FIG. 1A), and two exterior surfaces (310 and 312) that are each configured to be indirectly exposed to the coolant 120 in which the x-ray tube 200 is at least partially submerged via the manifold 314 and the plate 316, respectively. As the exterior surfaces 302, 304, 306, 308, 310, and 312 are directly or indirectly exposed to the circulating coolant 120 in which the x-ray tube 200 is at least partially submerged, the circulating coolant 120 functions to transfer the heat in the aperture body 300 caused by the impingement of the backscatter electrons 208*b* (see FIG. 1B) to the circulating coolant 120.

As disclosed in FIG. 3A, the aperture body 300 may further define a window frame 322 to which the x-ray tube window 206 (see FIG. 2A) is configured to be attached and through which x-rays 212*a* produced at the focal track 212 of the anode 210 may exit the aperture body 300 (see FIG. 1B). In addition, the aperture body 300 defines first and second interior coolant passageways 324 and 326. The first and second interior coolant passageways 324 and 326 may be formed using electrical discharge machining (EDM), for example, which allows for intricate and precise passageway geometries and avoids the difficulties associated with forming passageways by brazing various portions of the aperture body 300 together. The first interior coolant passageway 324 surrounds the window frame 322 and the second interior coolant passageway 326 surrounds the aperture 301. It is understood, however, that in some example embodiments, the window frame 322 may be separate from the aperture body 300, in which embodiments at least a portion of the first interior coolant passageway 324 would also be separate from the aperture body 300.

In addition, as disclosed in FIG. 3A, first fins 328 may be positioned within the overlapping portion of the first and second interior coolant passageways 324 and 326. Further, second fins 330 may be positioned within the second interior coolant passageway 326. Although the first and second fins 328 and 330 are offset fins, it is understood that the first and/or second fins 328 and 330 may instead be other types of fins, such as corrugated, louvered, perforated, straight, or some combination thereof. In addition, although only first and second fins 328 and 330 are disclosed in FIG. 3A, it is understood that only one set of fins, or three or more sets of fins, may instead be inserted into the first and/or second internal coolant passageways of the aperture body 300. The first and second fins 328 and 330 effectively extend the surface area of the interior surfaces the first and second interior coolant passageways 324 and 326, thus increasing the heat transfer rate of these surfaces.

The first fins 328 may be fixed within the overlapping portion of the first and second interior coolant passageways 324 and 326 in a variety of ways. For example, the first fins 328 may be inserted into the overlapping portion of the first and second interior coolant passageways 324 and 326, then fixed in place by deforming relatively thin regions 332 (see FIG. 2A) inward to have a dimpled shape. This dimpled shape may be accomplished by tapping on the relatively regions 332 with an appropriately shaped tool and a hammer, for example. The first fins 328 may further, or alternatively, be fixed in place by brazing the first fins 328 to one or more interior surfaces of the overlapping portion of the first and second interior coolant passageways 324 and 326. In at least some example embodiments, the use of the dimpled regions 332 to fix the first fins 328 in place may avoid the need to braze the first fins 328 in place, which may simplify the fixturing of the first fins 328. Finally, the overlapping portion of the first and second interior coolant passageways 324 and 326 may be at least partially sealed from the coolant 120 in which the x-ray tube 200 is at least partially submerged (see FIG. 1A) by attaching plates 334 to the aperture body 300, using fasteners 336 for example. This enables the coolant 120 circulating through the first and second interior coolant passageways 324 and 326 to remain separate from the coolant 120 in which the x-ray tube 200 is at least partially submerged (see FIG. 1A) until the coolant 120 exits the x-ray tube 200 through the coolant port B (see FIG. 2A).

Similarly, the second fins 330 may be fixed within the second interior coolant passageway 326 in a variety of ways. For example, the second fins 330 may be inserted into the second interior coolant passageway 326, and then fixed in place by attaching the plate 316 to the aperture body 300, using fasteners 320 for example. The attaching of the plate 316 also at least partially seals the second interior coolant passageway 326 from the coolant 120 in which the x-ray tube 200 is at least partially submerged (see FIG. 1A). The portion of the second interior coolant passageway 326 within which the second fins 330 are positioned may be sized such that the attaching of the plate 316 to the aperture body 300 sandwiches the second fins 330 between the plate 316 and the aperture body 300, thus fixing the second fins 330 in place. The second fins 330 may further, or alternatively, be fixed in place by brazing the second fins 330 to one or more interior surfaces of the second interior coolant passageway 326.

It is also understood that fins may be positioned within the first and/or second interior coolant passageways 324 and 326 by integrally forming the fins within one or both of these interior coolant passageways. For example, as disclosed in FIG. 1B, fins 331 are positioned within the first interior coolant passageway 324. The fins 331 are integrally formed within the first interior passageway 324. The fins 331 may be formed by machining the fins 331 during the machining of the first interior coolant passageway 324, for example. The fins 331 can then be sealed within the first interior coolant passageway 324 by attaching the manifold 314 to the aperture body 300.

As disclosed in FIG. 3B, as the coolant 120 circulates into the aperture body 300 through the port F, for example, a portion of the coolant 120 will circulate through the first interior coolant passageway 324 and another portion of the coolant 120 will circulate through the second interior coolant passageway 326 before exiting the aperture body through the port E. As the coolant 120 flows through the first and second interior coolant passageways 324 and 326 and past the first and second fins 328 and 330, the circulating coolant 120 functions to transfer the heat in the aperture body 300 caused by the impingement of the backscatter electrons 208*b* (see FIG. 1B) to the circulating coolant 120. In addition, in at least some example embodiments, as the coolant 120 circulates through the first and second interior coolant passageways 324 and 326, boiling of the coolant 120 may be induced to enhance the transfer rate of the heat in the aperture body 300 caused by the impingement of the backscatter electrons 208*b* (see FIG. 1B) to the circulating coolant 120.

With reference again to FIG. 1B, aspects of a trench 338 defined in the overlapping portion of the first and second interior coolant passageways 324 and 326 is disclosed. The trench 338 is defined proximate the window frame 322 and functions to elongate a relatively thin wall 340 between the overlapping portion of the first and second interior coolant passageways 324 and 326 and the window frame 322. As the aperture body 300 heats up during the operation of the x-ray tube 200, the aperture body 300 tends to expands and deform.

As the relatively thin wall 340 expands and deforms during x-ray tube operation, the trench 338 allows a portion of the elongated and relatively thin wall 340 to expand into the trench 338. The trench 338 thus relieves stress on the window 206, the window frame 322, and the bond between the window 206 and the window frame 322, for example. This relieved stress reduces the likelihood of stress-related failure, such as cracking, of the window 206.

It is understood that one alternative to the trench 338 is to extend a relatively thin-walled window frame (see FIG. 21 of U.S. Provisional Patent Application Ser. No. 61/249,534) above the top surface 308 of the aperture body 340, which would similarly relieve stress on the window 206, the extended window frame, and the bond between the window 206 and the extended window frame, for example.

With continuing reference to FIG. 1B, additional aspects of the window frame 322 are disclosed. In particular, the window frame 322 may include one or more narrowed portions 342. The one or more narrowed portions 342 of the window frame 322 may minimize backscatter electron heating of the window 206, while still maintaining sufficient width to allow sufficient x-rays 212*a* to exit the x-ray tube 200.

5. Example Brazing of the Aperture Body to the Can

Figure 4:
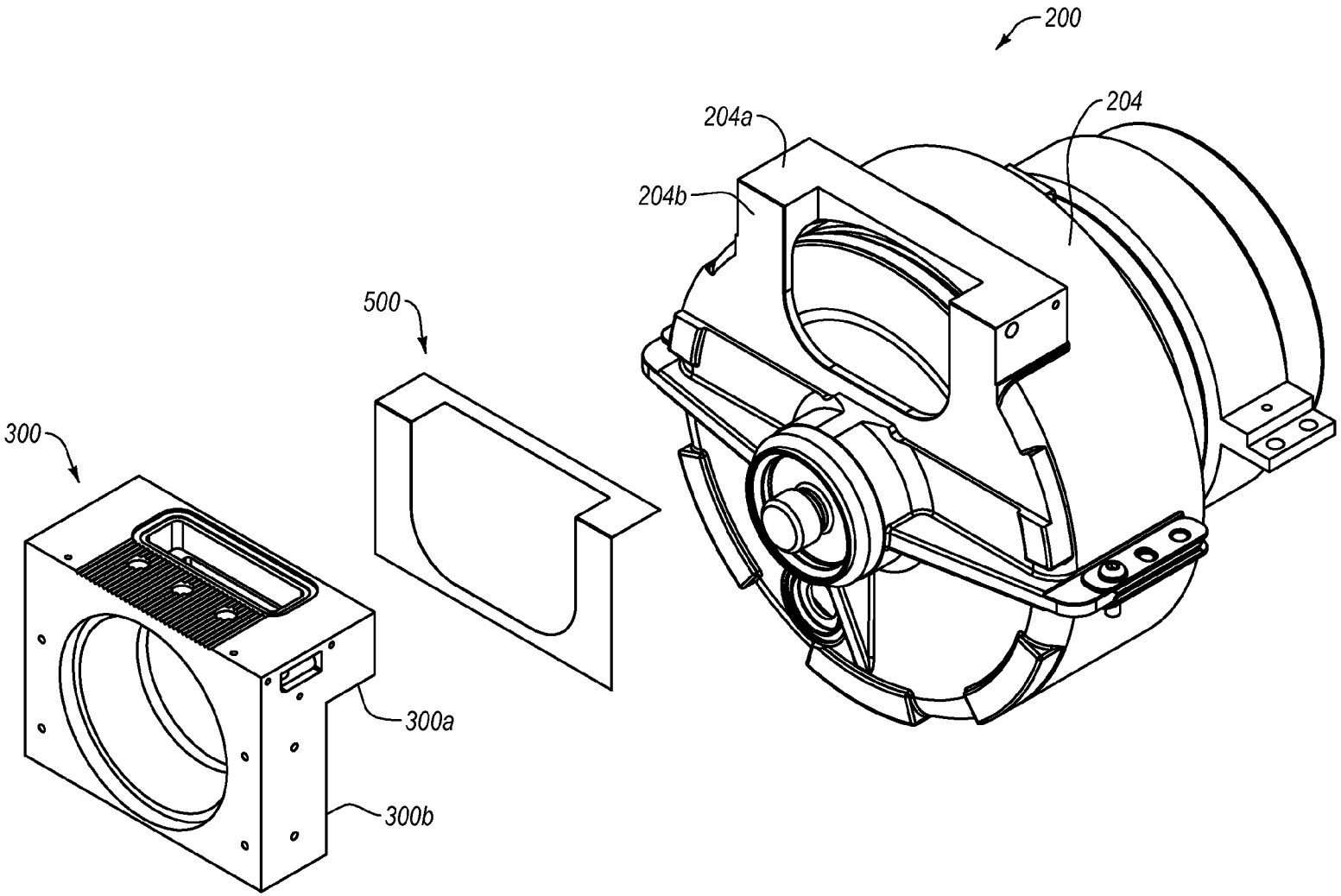
FIG. 4 is an exploded view of portions of the example x-ray tube of FIG. 1A.

With reference to FIG. 4, additional aspects of the aperture body 300 and the can 204 are disclosed. As disclosed in FIG. 4, the aperture body 300 defines two orthogonal brazing surfaces 300*a* and 300*b* that are configured to be brazed to two corresponding orthogonal brazing surfaces 204*a* and 204*b*, respectively, defined by the can 204. In one example embodiment, this brazing is accomplished by employing a braze washer 500 having a shape that corresponds to the orthogonal brazing surfaces 300*a* and 300*b* and 204*a* and 204*b*, which may simplify the process of brazing the aperture body 300 to the can 204. Brazing on the orthogonal brazing surfaces of the aperture body 300 and the can 204 allows for complex geometries, such as the complex geometry of the inverted L-shaped aperture body 300, to be implemented in the x-ray tube 200.

It is understood that in at least some example embodiments, the orthogonal brazing surfaces of the aperture body 300 and the can 204 may be replaced with one or more non-orthogonal brazing surfaces. For example, a single slanted brazing surface may replace the dual orthogonal brazing surfaces disclosed in FIG. 4. In addition, a corner plate (not shown) may be attached at the orthogonal braze interface between the aperture body 300 and the can 204 to prevent vacuum leaks. The corner plate may be employed as part of a standard design or may alternatively be used to repair vacuum leaks at the interface. Further, a braze reservoir (not shown) may be employed at the orthogonal braze interface to provide additional braze at the braze joint between the aperture body 300 and the can 204.

The example embodiments disclosed herein may be embodied in other specific forms. The example embodiments disclosed herein are therefore to be considered in all respects only as illustrative and not restrictive.

What is claimed is:

1. An x-ray tube configured to be at least partially submerged in a liquid coolant, the x-ray tube comprising:

a cathode at least partially positioned within a cathode housing;

an anode at least partially positioned within a can, the can being formed from a first material;

an x-ray window; and an aperture body formed from a second material, the aperture body coupling the cathode housing to the can, the aperture body defining an aperture through which electrons may pass between the cathode and the anode, the aperture body further defining at least two exterior surfaces that are each configured to be exposed to the liquid coolant in which the x-ray tube is at least partially submerged, the aperture body further defining a window frame to which the x-ray window is attached and through which x-rays produced at the anode may exit the aperture body, wherein at least fifty percent of the volume of the aperture body, excluding the volume of the aperture, is solid.

2. The x-ray tube as recited in claim 1, wherein the aperture body defines at least four exterior surfaces that are each configured to be exposed to the liquid coolant in which the x-ray tube is at least partially submerged.

3. The x-ray tube as recited in claim 1, wherein the cathode housing, the aperture body, the window, and the can at least partially define an evacuated enclosure.

4. The x-ray tube as recited in claim 3, wherein the aperture body further defines a first interior coolant passageway that surrounds the window frame.

5. An x-ray tube configured to be at least partially submerged in a liquid coolant, the x-ray tube comprising:

a cathode at least partially positioned within a cathode housing;

an anode at least partially positioned within a can, the can being formed from a first material;

an x-ray window; and an aperture body formed from a second material, the aperture body coupling the cathode housing to the can, the aperture body defining an aperture through which electrons may pass between the cathode and the anode, the aperture body further defining one or more exterior surfaces, the aperture body further defining a window frame to which the x-ray window is attached and through which x-rays produced at the anode may exit the aperture body, wherein at least fifty percent of the area of the exterior surfaces of the aperture body is configured to be exposed to the liquid coolant in which the x-ray tube is at least partially submerged.

6. The x-ray tube as recited in claim 5, wherein the aperture body further defines a first interior coolant passageway that surrounds the aperture.

7. The x-ray tube as recited in claim 6, further comprising fins positioned within the first interior coolant passageway.

8. The x-ray tube as recited in claim 7, wherein the fins are fixed in place within the first interior coolant passageway by dimpled regions of the aperture body.

9. The x-ray tube as recited in claim 6, wherein the first interior coolant passageway is at least partially sealed from the liquid coolant in which the x-ray tube is at least partially submerged by one or more plates attached to the aperture body.

10. The x-ray tube as recited in claim 6, wherein:

the aperture body further defines a second interior coolant passageway that surrounds the window frame.

11. The x-ray tube as recited in claim 10, further comprising flow guides positioned on the aperture body on either side of the x-ray tube window and configured to direct the coolant to flow across the x-ray tube window.

12. The x-ray tube as recited in claim 10, wherein the portion of the window frame to which the x-ray window is attached extends above a top surface of the aperture body.

13. The x-ray tube as recited in claim 10, wherein the second interior coolant passageway overlaps with the first interior coolant passageway.

14. The x-ray tube as recited in claim 13, wherein the overlapping portion of the first and second interior coolant passageways defines a trench proximate the window frame.

15. The x-ray tube as recited in claim 5, wherein:

the first material comprises stainless steel and has a first thermal conductivity; and the second material has a second thermal conductivity that is greater than the first thermal conductivity.

16. The x-ray tube as recited in claim 5, further comprising a plurality of fins attached to one or more exterior surfaces of the aperture body, the fins configured to be exposed to the liquid coolant in which the x-ray tube is at least partially submerged.

17. The x-ray tube as recited in claim 5, wherein at least fifty percent of the volume of the aperture body, excluding the volume of the aperture, is solid.

18. An x-ray tube configured to be at least partially submerged in a liquid coolant, the x-ray tube comprising:

a cathode at least partially positioned within a cathode housing;

an anode at least partially positioned within a can, the can is formed from a material comprising stainless steel;

an x-ray window; and an aperture body formed from a material comprising copper, the aperture body coupling the cathode housing to the can, the aperture body defining an aperture through which electrons may pass between the cathode and the anode, the aperture body further defining two planar orthogonal brazing surfaces that are brazed to two corresponding planar orthogonal brazing surfaces defined by the can the aperture body further defining a window frame to which the x-ray window is attached and through which x-rays produced at the anode may exit the aperture body.

19. A method of manufacturing the x-ray tube as recited in claim 18, wherein the two planar orthogonal brazing surfaces of the aperture body are brazed to the two corresponding planar orthogonal brazing surfaces of the can by employing a braze washer having a shape that corresponds to the planar orthogonal brazing surfaces.

20. The x-ray tube as recited in claim 18, further comprising a plurality of fins attached to one or more exterior surfaces of the aperture body, the fins configured to be exposed to the liquid coolant in which the x-ray tube is at least partially submerged.

21. The x-ray tube as recited in claim 20, wherein the fins are formed from a material that has a thermal conductivity that is greater than the thermal conductivity of material from which the can is formed.

* * * * *